United States Patent [19]

Takagi et al.

[11] 4,334,137

[45] Jun. 8, 1982

[54] ARRANGEMENT FOR COOKING EITHER WITH A HEAT SOURCE OR A MICROWAVE SOURCE

[75] Inventors: Hidehiko Takagi, Ichinomiya; Hisao Hayashi; Kazuo Ogawa, both of Nagoya; Yoshihiro Kanaya, Konan, all of Japan

[73] Assignee: Rinnai Kabushiki Kaisha, Fukuzumi, Japan

[21] Appl. No.: 86,066

[22] Filed: Oct. 18, 1979

[30] Foreign Application Priority Data

Oct. 25, 1978 [JP] Japan ..... 53-145776

[51] Int. Cl.[3] ..... H05B 6/74

[52] U.S. Cl. ..... 219/10.55 F; 219/10.55 R; 219/400

[58] Field of Search ..... 219/10.55 F, 10.55 R, 219/10.55 B, 10.55 E, 400

[56] References Cited

U.S. PATENT DOCUMENTS

| | | | |
|---|---|---|---|
| 3,965,325 | 6/1976 | Hirai | 219/10.55 R |
| 4,097,709 | 6/1978 | Bächtold et al. | 219/10.55 R |
| 4,144,437 | 3/1979 | Ehlers | 219/10.55 R X |
| 4,154,861 | 5/1979 | Smith | 219/10.55 M X |
| 4,211,909 | 7/1980 | Yoshida et al. | 219/10.55 R |

FOREIGN PATENT DOCUMENTS

| | | | |
|---|---|---|---|
| 2605699 | 8/1977 | Fed. Rep. of Germany . | |
| 2715636 | 11/1977 | Fed. Rep. of Germany . | |
| 2616015 | 8/1979 | Fed. Rep. of Germany . | |
| 49-34440 | 3/1974 | Japan | 219/10.55 R |
| 52-11441 | 1/1977 | Japan | 219/10.55 F |
| 52-7583 | 3/1977 | Japan | 219/10.55 F |
| 54-2534 | 1/1979 | Japan | 219/10.55 F |
| 984424 | 2/1965 | United Kingdom . | |
| 1029995 | 5/1966 | United Kingdom . | |
| 1135477 | 12/1968 | United Kingdom . | |
| 1493408 | 11/1977 | United Kingdom . | |
| 1494426 | 12/1977 | United Kingdom . | |
| 1509116 | 4/1978 | United Kingdom . | |
| 1543503 | 4/1979 | United Kingdom . | |
| 1546114 | 5/1979 | United Kingdom . | |

*Primary Examiner*—B. A. Reynolds
*Assistant Examiner*—Philip H. Leung
*Attorney, Agent, or Firm*—Leonard Bloom

[57] ABSTRACT

A cooking apparatus of the type that a heating chamber is provided with a heat source and a magnetron so that cooking by heat of the heat source and cooking by microwave of the magnetron can be carried out. There are provided, on the outer side of the heating chamber, a stirrer chamber and a waveguide which is in communication therewith and is disposed on the output side of the magnetron. There is provided, on the further outer side thereof, a ventilation duct which is in communication with a cooling fan. There are disposed in the ventilation duct on the upstream side and on the downstream side thereof a radiation fin of the magnetron and a windmill for driving a stirrer provided in the stirrer chamber.

5 Claims, 3 Drawing Figures

ARRANGEMENT FOR COOKING EITHER WITH A HEAT SOURCE OR A MICROWAVE SOURCE

FIELD OF THE INVENTION

This invention relates to a cooking apparatus of the type that a heating chamber is provided with a heat source such as a gas burner or the like and a magnetron so that cooking by heat of the heat source and cooking by microwave of the magnetron can be carried out.

PRIOR ART

It is generally desirable with this kind of apparatus that the interior of a waveguide which is in communication with an output side of the magnetron and that of a stirrer chamber located on its downstream side are shut off from hot gas in the heating chamber and ventilation air for cooling so as not to be influenced thereby.

SUMMARY OF THE INVENTION

This invention has for its object to provide a cooking apparatus which can satisfy this requirement. According to this invention, in an apparatus of the type that a heating chamber 1 is provided with a heat source 2 such as a gas burner, an electric heater or the like and a magnetron 3 so that cooking by heat of the heat source 2 and cooking by microwave of the magnetron 3 can be carried out, it is characterized in that there are provided on the outer side of the heating chamber 1 a stirrer chamber 5 partitioned air-tightly therefrom by a partition plate 4 and a waveguide 6 which is disposed on an output side of the magnetron 3 so as to be in communication with the stirrer chamber 5 and extend sidewards therefrom, and there is provided on the further outer side thereof a ventilation duct 8 which is in communication with a cooling fan 7, and there are disposed in the ventilation duct 8 on the upstream side and on the downstream side thereof a radiation fin 9 on the base end portion of the magnetron 3 and a windmill 12 on a shaft 11 of a stirrer 10 provided in the stirrer chamber 5.

DETAILED DESCRIPTION

Figure 1:
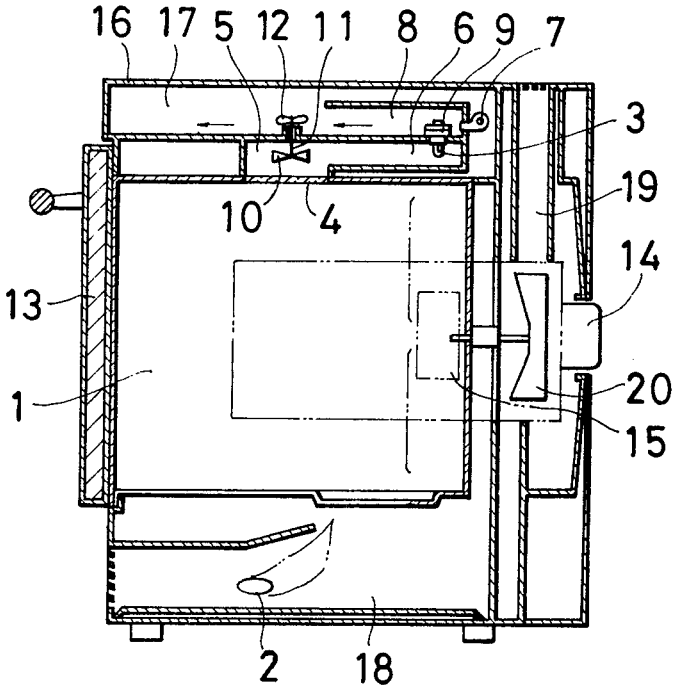
FIG. 1 is a sectional side view of one example of this invention apparatus.

Embodying examples of this invention will now be explained with reference to the attached drawings:

FIG. 1 shows one embodying example of this invention.

Referring to the drawings, numeral 1 denotes a heating chamber 1. The heating chamber 1 is provided with a heat source 2 such as a gas burner, an electric heater or the like and a magnetron 3 so that cooking by heat of the heat source 2 and cooking by microwave of the magnetron 3 can be carried out.

According to this invention, there are provided on the outer side of the heating chamber 1 a stirrer 5 partitioned air-tightly therefrom by a partition plate 4 and a waveguide 6 which is so disposed on an output side of the magnetron 3 as to be in communication with the stirrer chamber 5 and extend sidewards therefrom. There is provided on the further outside thereof a ventilation duct 8 which is in communication with a cooling fan 7, and there are disposed in the ventilation duct 8 on the upstream side and on the downstream side thereof a radiation fin 9 on the base end portion of the magnetron 3 and a windmill 12 on a shaft 11 of a stirrer 10 provided in the stirrer chamber 5.

The heating chamber 1 is provided on its front surface with an opening and closing door 13, and is provided therein, as occasion demands, with an agitating fan 15 driven by an electric motor 14 on its rear side, and is additionally provided on its peripheral sides with a main body casing 16. The foregoing members such as the stirrer chamber 5, the waveguide 6, the ventilation duct 8 and others are provided in an upper space formed in the casing 16. In this case, the duct 8 is so provided that its downstream end opening portion is directed towards a control chamber 17 formed in front thereof and thereby air-cooling of the control chamber 17 also can be carried out.

Figure 2:
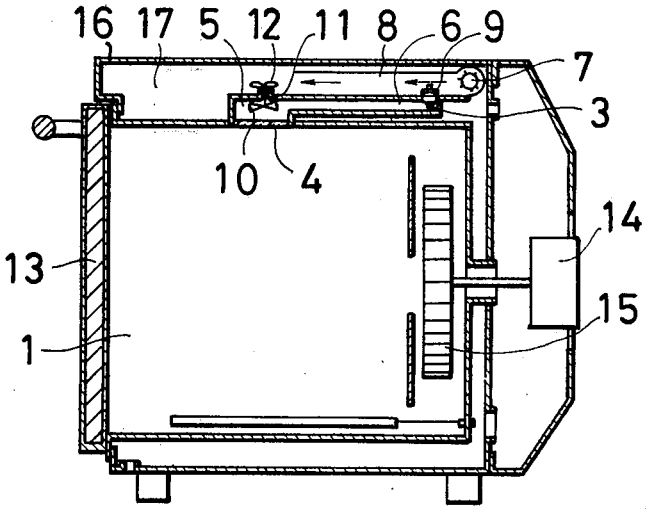
FIGS. 2 and 3 are sectional side views of modified examples thereof.
Figure 3:
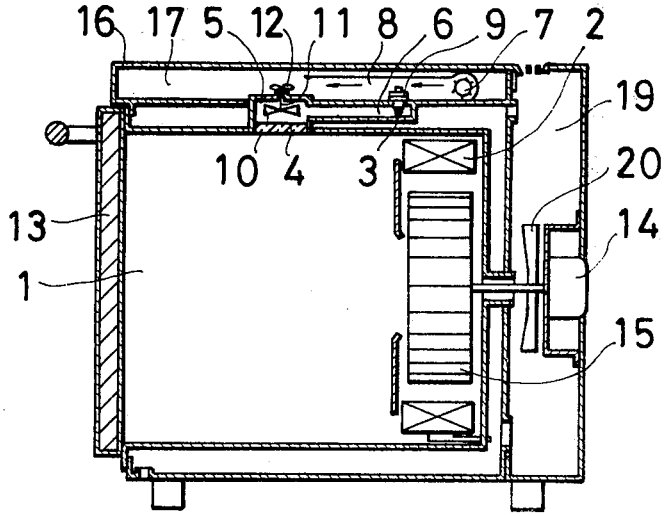

The heat source 2 may be of any desired type. Namely, the same is composed of a gas burner in a combustion chamber 18 provided below the heating chamber 1 as shown in FIG. 1, or is composed of an electric heater at the bottom of the heating chamber 1 as shown in FIG. 2, further or is an electric heater around the agitating fan 15 as shown in FIG. 3.

Referring to the drawings, numeral 19 denotes an exhaust passage for discharging the combustion hot gas or internal hot air to the exterior, and, as occasion demands, this passage 19 is provided therein with an exhaust fan 20, driven by the foregoing motor 14. The foregoing partition plate 4 is made of heat-resisting glass, for instance, so as to allow microwave to pass therethrough.

The operation of the apparatus will now be explained as follows:

If the heat source 2 is activated, the interior of the heating chamber 1 is heated and cooking by heat thereof is carried out therein. If the magnetron 3 is operated, the output thereof is introduced into the heating chamber 1 from the waveguide 6, through the interior of the stirrer chamber 5 and through the partition plate 4, and cooking by microwave thereof can be carried out therein. This is not especially different from that in a conventional apparatus. However, according to this invention, during this cooking operation, the cooling fan 7 is operated, and consequently the cooling air flows through the ventilation duct 8 and acts, on its upstream side, on the radiation fin 9 of the magnetron 3 so as to air-cool the same and acts, on the downstream side, on the windmill 12 so as to drive the stirrer 10 to turn. During this operation, the interiors of the stirrer chamber 5 and the waveguide 6 which is in communication therewith are isolated from the hot gas in the heating chamber 1 and from the cooling air in the ventilation duct 8 on the upper side thereof and can be protected from the influence thereof.

Thus, according to this invention, the respective interiors of the stirrer chamber 5 and the waveguide 6 which is in communication therewith are shut off from both of the hot gas in the heating chamber 1 and the cooling air in the ventilation duct 8, and consequently can be free from any influence thereby, and thus the magnetron 3 can be free from any lowering in operation efficiency by being spoiled with dirt or the like and can be used for a long time at a high efficiency. Further, the stirrer 10 is arranged to be driven through the windmill 12 by the cooling air, so that it becomes unnecessary to provide any separate driving source. Additionally it is possible to use the cooling air effectively also for cooling a control chamber or the like.

What is claimed is:

1. An apparatus for cooking either with a heat source or a microwave source, comprising: a heating chamber provided with a heat source; a stirrer chamber on an outer side of said heating chamber; a partition plate air-tightly separating the heating chamber from the stirrer chamber; a waveguide in communication with said stirrer chamber and extending sidewards therefrom; a magnetron having an output connected to the waveguide, whereby cooking by heat from the heat source and cooking by microwave with the magnetron can be carried out as selected; a ventilation duct on the outer side of said stirrer chamber and said waveguide; a cooling fan in communication with said ventilation duct; said ventilation duct having upstream and downstream sides; a radiation fin on said magnetron and disposed in the upstream side of said ventilation duct; a windmill on the downstream side of said ventilation duct; a stirrer in said stirrer chamber; a shaft connecting said stirrer to said windmill; and said stirrer chamber and said ventilation duct being partitioned air-tightly to prevent microwave leakage.

2. A cooking apparatus as claimed in claim 1, wherein said heat source comprises a gas burner in a combustion chamber below said heating chamber.

3. A cooking apparatus as claimed in claim 1, wherein said heat source comprises an electric heater at the bottom of said heating chamber.

4. A cooking apparatus as claimed in claim 1, wherein said heat source comprises an electric heater around an agitating fan in said heating chamber.

5. A cooking apparatus as defined in claim 1 wherein said partition plate comprises a heat resisting glass.

* * * * *